US006825159B2

(12) United States Patent
Man et al.

(10) Patent No.: US 6,825,159 B2
(45) Date of Patent: Nov. 30, 2004

(54) ALKALINE CLEANING COMPOSITION WITH INCREASED CHLORINE STABILITY

(75) Inventors: Victor Fuk-Pong Man, St. Paul, MN (US); Steven Eugene Lentsch, St. Paul, MN (US); Janel Marie Kieffer, Hastings, MN (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 10/271,871

(22) Filed: Oct. 15, 2002

(65) Prior Publication Data

US 2004/0072712 A1 Apr. 15, 2004

(51) Int. Cl.[7] ..... C11D 17/00
(52) U.S. Cl. ..... 510/302; 510/379; 510/422; 510/380; 510/381
(58) Field of Search ..... 510/302, 379, 510/422, 380, 381

(56) References Cited

U.S. PATENT DOCUMENTS 3,048,548 A 8/1962 Martin et al.
3,334,147 A 8/1967 Brunelle et al.
3,442,242 A 5/1969 Laskey et al.
5,108,641 A * 4/1992 Ahmed et al. ..... 252/94
5,185,096 A * 2/1993 Ahmed ..... 252/99
5,219,486 A * 6/1993 Ahmed et al. ..... 252/94
5,229,027 A * 7/1993 Ahmed ..... 252/99
6,369,021 B1 4/2002 Man et al.
6,489,278 B1 12/2002 Lentsch et al.

* cited by examiner

*Primary Examiner*—Necholus Ogden
(74) *Attorney, Agent, or Firm*—Crompton Seager Tufte, LLC

(57) ABSTRACT

A cleaning composition including a less than fully ionized source of alkalinity within the cleaning composition, a source of chlorine, and a polar carrier. In at least some embodiments, it has been found that chlorine has an increased level of stability within the cleaning composition relative to a second composition having similar components and a similar level of titratable alkalinity, but that includes a fully ionized source of alkalinity as a sole source of alkalinity. Some other embodiments relate to methods of making, and methods of using such cleaning compositions.

47 Claims, No Drawings

ALKALINE CLEANING COMPOSITION WITH INCREASED CHLORINE STABILITY

FIELD OF THE INVENTION

The invention relates to cleaning compositions and, more particularly, to alkali cleaning compositions that provides for an increased level of stability for a chlorine component within the composition.

BACKGROUND

Many cleaner compositions are presently used in many applications, such as retail, industrial and institutional applications. In many such compositions, a source of alkalinity is provided for soil removal. Additionally, in some compositions, it is also desirable to provide a source of chlorine to aid in sanitizing, bleaching, cleaning, or the like. However, it has been found that in many such compositions, the stability of the chlorine within such alkaline compositions is less than may be desired.

There remains a need, therefore, for cleaning compositions with cleaning capabilities where the composition has a desired level of alkalinity, and also has an increased level of chlorine stability.

SUMMARY OF SOME EMBODIMENTS

Some embodiments of the invention relate to a cleaning composition including a less than fully ionized source of alkalinity within the cleaning composition, a source of chlorine, and a polar carrier. In at least some embodiments, it has been found that chlorine has an increased level of stability within the cleaning composition relative to a second composition having similar components and a similar level of titratable alkalinity, but that includes a fully ionized source of alkalinity as a sole source of alkalinity.

Some other embodiments relate to methods of making, and methods of using such cleaning compositions.

DETAILED DESCRIPTION OF SOME EMBODIMENTS

For the following terms, these meanings shall be applied, unless a different meaning is given or indicated in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

Compositions

In at least some embodiments, the invention relates to a cleaning composition including a source of alkalinity that is less than fully ionized within the cleaning composition, a source of chlorine, and a polar carrier. Some embodiments may also include additional functional materials, as desired, to give the composition certain properties or cleaning capacity. Below is a discussion of some example components that can be used in cleaning compositions in accordance with some embodiments.

Less than Fully Ionized Source of Alkalinity

As indicated above, the composition includes a source of alkalinity that is less than fully ionized within the cleaning composition. As used herein, a "less than fully ionized" or "ionizable" source of alkalinity refers to an alkalinity providing species that when included within the composition, includes a portion of the amount added to the composition that does not provide a stoichiometric amount of free ions within the composition. For example, a source of alkalinity that does not fully dissociate when included within the cleaning composition would be considered a less than fully ionized source of alkalinity. By not fully dissociated, it can be meant that at least a portion of the component is in the form of an undissolved solid that can be dispersed within the composition. Furthermore, not fully dissociated can also mean that the undissociated portion of the alkalinity providing component is in the form of a colloidal suspension within the composition.

Another example of a less than fully ionized or ionizable source of alkalinity includes species that when included within the cleaning composition, includes a portion of the amount added that forms ion pairs within the composition. That portion of the species that forms ion pairs, therefore, does not provide free ions within the composition, and is therefore less than fully ionized.

It has been found that sources of alkalinity that are less than fully ionized within the composition provide for better chlorine stability within such alkali cleaning compositions. While not wishing to be held to any theory as to the nature of compositions in accordance with the invention, it is believed that increases in the concentration of fully ionized sources of alkalinity within at least some cleaning compositions negatively effects the stability of chlorine or a source of chlorine within the composition. It is theorized, for example, that fully ionized or ionizable sources of alkalinity, such as sodium hydroxide or potassium hydroxide, may increase the ionic strength of the composition and negatively effect chlorine stability. In fact, as can be seen in the examples below, it has been found that increases in the concentration of such fully ionizable sources of alkalinity negatively impacts chlorine stability. However, by providing a less than fully ionized or ionizable source of alkalinity as at least a portion of the alkalinity providing species in a cleaning composition, the level of titratable alkalinity can be increased within the composition while still maintaining a desired level of chlorine stability. For example, it has been found that cleaning compositions that include a less than fully ionized or ionizable source of alkalinity have an increased level of chlorine stability within the cleaning composition relative to a second composition having substantially the same components and substantially the same level of titratable alkalinity, but that includes a fully ionized source of alkalinity as a sole source of alkalinity.

Some examples of suitable sources of alkalinity that can provide a less than fully ionized or ionizable source of alkalinity within the compositions can include a silicate salt, a phosphate salt, a polyphosphate salt, a carbonate salt, a borate salt, or the like, or combinations or mixtures thereof. Some examples of specific compounds include sodium silicate, sodium metasilicate, sodium orthosilicate, sodium phosphate, sodium polyphosphate, sodium borate, sodium carbonate, potassium silicate, potassium metasilicate, potassium orthosilicate, potassium phosphate, potassium polyphosphate, potassium borate, potassium carbonate, lithium silicate, lithium metasilicate, lithium orthosilicate, lithium phosphate, lithium polyphosphate, lithium borate, lithium carbonate, or the like, or combinations or mixtures thereof.

The amount of less than fully ionized source of alkalinity included within a particular cleaning composition can be dependent upon the desired level of alkalinity, which in turn can also be dependent upon the amount of additional sources of alkalinity within the composition. Additionally, the amount of less than fully ionized source of alkalinity included within a particular cleaning composition is also dependent upon the desired level of chlorine stability. For example, in some embodiments, the less than fully ionized source of alkalinity can be the sole source of alkalinity within the composition, and is therefore present in the composition to provide the desired level of alkalinity while maintaining a degree of chlorine stability. In some other embodiments, one or more additional sources of alkalinity can be present in the composition, and the amount of less than fully ionized source of alkalinity can be varied to provide the desired final level of titratable alkalinity, and to provide for increased chlorine stability at those alkalinity levels compared to compositions using only fully ionized sources of alkalinity.

In at least some embodiments, it is believed that the greater the amount of less than fully ionized source of alkalinity within the composition relative to the amount of fully ionized sources of alkalinity, the greater the chlorine stability. In some example embodiments, the weight percent ratio of less than fully ionized source of alkalinity to fully ionized sources of alkalinity is in the range of about 100:0 to about 5:100, in the range of about 10:1 to about 1:10, or in the range of about 8:2 to about 2:8, or in the range of 7:3 to about 3:7.

In at least some embodiments, the less than fully ionized source of alkalinity may be present in the range of about 0.5 to about 60%, or about 1 to about 40%, or 5 to about 40%, or 10 to about 40% by weight based on the total weight of a particular cleaning composition. It should be understood that these ranges can vary, depending, for example, upon factors such as the desired level of alkalinity, the amount of other sources of alkalinity present in the composition, and the desired level of chlorine stability. For example, in some embodiments with lower levels of alkalinity, the less than fully ionized source of alkalinity may be present in the range of about 0.5 to about 5% by weight based on the total weight of a particular cleaning composition.

Source of Chlorine

The composition can also include a source of chlorine for sanitizing, bleaching, cleaning, and the like. Some examples of classes of compounds that can act as sources of chlorine include a hypochlorite, a chlorinated phosphate, a chlorinated isocyanaurate, a chlorinated melamine, a chlorinated amide, and the like, or mixtures of combinations thereof.

Some specific examples of sources of chlorine can include sodium hypochlorite, potassium hypochlorite, calcium hypochlorite, lithium hypochlorite, chlorinated trisodiumphosphate, sodium dichloroisocyanurate, potassium dichloroisocyanurate, pentaisocyanurate, trichloromelamine, sulfondichloro-amide, 1,3-dichloro 5,5-dimethyl hydantoin, N-chlorosuccinimide, N,N'-dichloroazodicarbonimide, N,N'-chloroacetylurea, N,N'-dichlorobiuret, trichlorocyanuric acid and hydrates thereof, or combinations or mixtures thereof.

The source of chlorine is included within the composition in an amount to provide the desired level of chlorine concentration. In at least some embodiments, the source of chlorine may be present in the range of about 0.5 to about 50%, or about 0.5 to about 40%, or about 2 to about 35% by weight based on the total weight of a particular cleaning composition. It should be understood that these ranges can vary, depending, for example, upon factors such as the desired level of chlorine, and the desired level of chlorine stability.

As discussed above, the stability level of at least a portion of the source of chlorine, or at least a portion of the chlorine produced by the source of chlorine within a particular composition, can be increased by using the less than fully ionized or ionizable source of alkalinity. In some compositions, the source of chlorine, or chlorine produced thereby, has in the range of about 10% or less, or about 20% or less, or about 30% or less, or about 40% or less, or about 50% or less loss of activity over a one month period of time when the composition is stored at room temperature.

Typically, the degradation of chlorine or source of chlorine within the composition when stored at room temperature follows a second order reaction. In some embodiments, the second order rate constant for the degradation of the chlorine within the composition when the composition is stored at room temperature is in the range of about 0.001 and 0.01 $(\%\ \text{day})^{-1}$.

Polar Carrier

The cleaning compositions of the invention may include a polar carrier media, such as water and the like, or other chlorine compatible polar solvents, or mixtures and combinations thereof.

The polar carrier typically makes up the balance of the weight percent of the composition once the amounts of the other ingredients have been determined. In some example embodiments, the polar carrier may be present in the composition in the range of about 10 to about 90%, in the range of about 20 to about 80%, or in the range of about 25 to 75% by weight based on the total weight of the composition.

Additional Materials

The compositions may also include additional materials, such as additional functional materials, for example, an additional source of alkalinity, a surfactant, a chelating agent, a sequestering agent, a bleaching agent, a thickening agent, a solubility modifier, a detergent filler, a defoamer, an anti-redeposition agent, a threshold agent or system, an aesthetic enhancing agent (i.e. dye, perfume, ect.) and the like, or combinations or mixtures thereof. Adjuvants and other additive ingredients will vary according to the type of composition being manufactured and can be included in the compositions in any amount. In at least some embodiments, any additional functional materials that are added to the composition are compatible with the other components within the composition. For example, because chlorine will be substantially present within most compositions, it may be useful that any additional materials be chlorine compatible. The following is a brief discussion of some examples of such additional materials.

Additional Source of Alkalinity

An additional alkalinity source may be provided to enhance cleaning of a substrate, improve soil removal, to increase the pH of the composition, or to perform other functions. The additional source of alkalinity can include any alkalinity producing material that is generally compatible with other components within the given composition. In some embodiments, the additional source of alkalinity can be fully ionizable within the composition. As discussed above, however, in at least some embodiments, as the level of fully ionizable sources of alkalinity within the composition is increased, the level of stability of chlorine within the composition may fall.

Some examples of additional sources of alkalinity include alkali metal salts, alkali earth metal salts, ammoniums, protonated amines, protonated alkanol amines, or the like, and combinations or mixtures thereof.

These additional sources of alkalinity may be present in cleaning compositions in the range of up to about 95 wt-%, up to about 70 wt-%, up to about 40 wt-%, up to about 30 wt-%, up to about 20 wt-%, or up to about 10 wt-% of the total composition.

Surfactants

Surfactants may be present in some compositions embodying the invention. Any surfactant that is compatible with chlorine can be used. The surfactant or surfactant admixture can be selected from nonionic, semi-polar nonionic, anionic, cationic, amphoteric, or zwitterionic surface-active agents; or any combination thereof. In at least some embodiments, the surfactants are water soluble or water dispersible. The particular surfactant or surfactant mixture chosen for use in the process and products of this invention can depend on the conditions of final utility, including method of manufacture, physical product form, use pH, use temperature, foam control, and soil type. For a discussion of surfactants, see Kirk-Othmer, Encyclopedia of Chemical Technology, Third Edition, volume 8, pages 900–912. The composition may include a surfactant in an amount effective to provide a desired level of cleaning, such as 0–20 wt %, or 0.5–18 wt %, or 1–17 wt %, or 1.5–15 wt %. Some examples of suitable surfactants include phosphate esters, alkyl alkoxy alkanoates, alkyl phenoxy alkoxy alkanoates, alkyl carboxylates, or the like, or combinations or derivatives thereof.

Chelating/Sequestering Agent

The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. The composition may include 0.1–70 wt %, or 5–60 wt %, of a chelating/sequestering agent. An iminodisuccinate (available commercially from Bayer as IDS™) may be used as a chelating agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like.

The composition may include a phosphonate such as 1-hydroxyethane- 1,1-diphosphonic acid, 2-phosphonobutane-1,2,4 tricarboxylic acid, and the like.

Polymeric polycarboxylates may also be included in the composition. Those suitable for use as cleaning agents have pendant carboxylate groups and include, for example, polyacrylic acid, maleic/olefin copolymer, acrylic/maleic copolymer, polymethacrylic acid, acrylic acid-methacrylic acid copolymers, and the like. For a further discussion of chelating agents/sequestrants, see Kirk-Othmer, Encyclopedia of Chemical Technology, Third Edition, volume 5, pages 339–366 and volume 23, pages 319–320, the disclosure of which is incorporated by reference herein.

Thickening Agent

In some embodiments, a thickening agent may be included. Some examples of thickeners include soluble organic or inorganic thickener material. Some examples of inorganic thickeners include clays, silicates and other well known inorganic thickeners. Some examples of organic thickeners include thixotropic and non-thixotropic thickeners. In some embodiments, the thickeners have some substantial proportion of water solubility to promote easy removability. Examples of useful soluble organic thickeners for the compositions of the invention comprise carboxylated vinyl polymers such as polyacrylic acids and alkali metal salts thereof, and other similar aqueous thickeners that have some substantial proportion of water solubility.

Bleaching Agents

The composition may include a bleaching agent in addition to or in conjunction with the source of chlorine. Bleaching agents for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents include, for example, chlorine-containing compounds such as a chlorine, a hypochlorite, a chlorinated phosphate, a chlorinated isocyanaurate, and the like. Halogen-releasing compounds may include the alkali metal dichloroisocyanurates, chlorinated trisodium phosphate, the alkali metal hypochlorites, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, such as 0.1–10 wt %, or 1–6 wt %.

Detergent Builders or Fillers

A composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, and the like. Inorganic or phosphate-containing detergent builders may include alkali metal salts of polyphosphates (e.g. tripolyphosphates, pyrophosphates, and glassy polymeric meta-phosphates), and the like. Non-phosphate builders may also be used. A detergent filler may be included in an amount of 1–20 wt %, or 3–15 wt %.

Defoaming Agents

A minor but effective amount of a defoaming agent for reducing the stability of foam may also be included in the compositions. The cleaning composition can include 0.01–5 wt % of a defoaming agent, or 0.01–3 wt %.

Examples of defoaming agents include silicone compounds such as silica dispersed in polydimethylsiloxane, fatty amides, hydrocarbon waxes, fatty acids, fatty acid soaps, alkoxylates, mineral oils, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-redeposition Agents

The composition may include an anti-redeposition agent capable of facilitating sustained suspension of soils in a cleaning solution and preventing the removed soils from being redeposited onto the substrate being cleaned. Examples of suitable antiredeposition agents include fatty acid amides, fluorocarbon surfactants, complex phosphate esters, styrene maleic anhydride copolymers, and the like. The composition may include 0.5–10 wt %, or 1–5 wt %, of an anti-redeposition agent.

Dyes/Odorants

Chlorine compatible dyes, pigments, and fragrances can be used.

Divalent Ion

The compositions may contain a divalent ion, selected from calcium and magnesium ions, at a level of from 0.05% to 5% by weight, or from 0.1% to 1% by weight, or 0.25% by weight of the composition. The divalent ion can be, for example, calcium or magnesium. The calcium ions can, for example, be added as a chloride, hydroxide, oxide, and the like.

The compositions of the invention may also contain additional typically nonactive materials, with respect to cleaning properties, generally found in liquid pretreatment or detergent compositions in conventional usages. These ingredients are selected to be compatible with the materials of the invention and include such materials as fabric softeners, optical brighteners, soil suspension agents, germicides, viscosity modifiers, inorganic carriers, solidifying agents and the like.

Methods of Making

The cleaning compositions can be made by combining a less than fully ionized or ionizable source of alkalinity, optionally a source of fully ionized or ionizable of alkalinity; a source of chlorine; and a polar carrier, as each of these components are described above. In at least some embodiments, the above processes can be used to produce a product having a stable single phase. In other embodiments, a dispersion, or colloidal suspension can be created. The compositions can be diluted with aqueous and/or non aqueous materials to form a use solution of any strength and viscosity depending on the application. The compositions may be in the form of a liquid, gel, paste, structured liquid, a dispersion, a colloidal suspension, and the like. The composition can be uniform or non-uniform. The compositions and diluted use solutions may be useful as cleaners, destainers, sanitizers, and the like, for example, for surfaces, laundry, warewashing, cleaning-in-place, medical cleaning and sanitizing, vehicle care, floors, and the like.

The alkalinity and chlorine content and stability of the cleaning composition can be tailored by varying the amount and type of the source of alkalinity, and source of chlorine. In some embodiments, the composition can have a pH in the range of about 10 or above, and can have viscosities in the range of about 10 to about 3000, in the range of about 25 to 1500, or in the range of about 50 to 1000 cps.

EXAMPLES

Example 1

The following two tables show some example components and example weight percents ranges for some examples compositions that are in accordance with some embodiments of the invention. Table 1 shows some example compositional ranges for a more alkaline chlorinated cleaner composition, while Table 2 shows some example compositional ranges for a less alkaline chlorinated cleaner composition. It should be understood that these formulations are given by way of example only.

TABLE 1

Some Examples of Typical Compositional Ranges of a More Alkaline Chlorinated Cleaner

| Class of Ingredients | Some Example Ingredients | Concentration Range (wt. %) |
|---|---|---|
| Polar Carrier | Water | Balance |
| Chlorine source | NaOCl, KOCl | 0.5–12 |
| Less than fully ionized source of alkalinity | Sodium metasilicate, Potassium metasilicate | 1–40 |
| Fully ionized alkalinity source | NaOH, KOH | 0–30 |
| Chlorine compatible chelating/sequestrating agent | Bayhibit AM, polyacrylates (e.g. Acusol 445), TKPP, STPP | 0–30 |
| Chlorine compatible surfactants/protein soil defoamers | Alkyl alkoxy alkanoates (e.g. Mona NF-10) Alkyl phenoxy alkoxy alkanoates (e.g. Mona NF-15, NF-25) Alkyl carboxylates Phosphate ester (e.g. Monatrope 1296) Silicone defoamers (e.g. Maza DF 100-s and CS-10A/Ducey) Amine oxides | 0–20 |
| Chlorine compatible thickener | High M.W. polyacrylates (e.g. Carbopol 676) Clay thickener (e.g. Gelwhite H NF) | 0–5 |

TABLE 2

Some Example Compositional Ranges of a Less Alkaline Chlorinated Cleaner

| Class of Ingredients | Some Example Ingredients | Concentration Range (wt. %) |
|---|---|---|
| Water | | Balance |
| Chlorine source | NaOCl, KOCl | 0.5–12 |
| Less than fully ionized source of alkalinity | Sodium metasilicate, Potassium metasilicate | 0.5–5 |
| Fully ionized alkalinity source | NaOH, KOH | 0–5 |
| Chlorine compatible chelating/sequestrating agent | Bayhibit AM, polyacrylates (e.g. Acusol 445), TKPP, STPP | 0–5 |
| Chlorine compatible surfactants/protein soil defoamers | Alkyl alkoxy alkanoates (e.g. Mona NF-10) Alkyl phenoxy alkoxy alkanoates (e.g. Mona NF-15, NF-25) Alkyl carboxylates Phosphate ester (e.g. Monatrope 1296) Silicone defoamers (e.g. Maza DF 100-s and CS-10A/Ducey) Amine oxides | 0–5 |
| Chlorine compatible thickerer | High M.W. polyacrylates (e.g. Carbopol 676) Clay thickener (e.g. Gelwhite H NF) | 0–5 |

Example 2

In this example, a series of 30 formulations were made, and the chlorine stability of these formulations was measured when stored at room temperature. Some of the compositions are in accordance with the invention in that they include a less than fully ionized source of alkalinity, while others are comparative compositions that include fully ionized sources of alkalinity as the sole source of alkalinity. Tables 3–8 summarize the components and weight percents of the formulations.

TABLE 3

| | Formulations 1–5 | | | | |
|---|---|---|---|---|---|
| | Formulation Number | | | | |
| | 1 | 2 | 3 | 4 | 5 |
| DI Water | 40.465 | 40.465 | 25.00 | 23.00 | 23.00 |
| Carbopol 672 | 0.75 | 0.75 | — | — | — |
| Oxyrite | 0.075 | 0.075 | — | — | — |
| STPP, Commercial | 20.00 | 20.00 | 10.00 | 10.00 | 10.00 |
| Poly Carboxylic Acid; 20% Neutralized | — | — | 4.00 | 4.00 | 4.00 |
| Phosphono Butane Tricarboxy Acid | — | — | 1.00 | 1.00 | 1.00 |
| NaOH beads | 5.00 | 5.00 | — | — | — |
| KOH(45%) | — | — | 20.00 | 20.00 | 20.00 |
| Potassium Hypochlorite (8.15% $Cl_2$) | — | — | 40.00 | 40.00 | 40.00 |
| Sodium hypochlorite (8.2% $Cl_2$) | 31.71 | 31.71 | — | — | — |
| CS-10A/Ducey | 2.00 | — | — | — | — |
| Mazu DF 100-S | — | 2.00 | — | — | — |
| Monatrope 1296 | — | — | — | 2.00 | — |
| Mona NF-25 | — | — | — | — | 2.00 |
| Total | 100.00 | 100.00 | 100.00 | 100.00 | 100.00 |

TABLE 4

| | Formulations 6–10 | | | | |
|---|---|---|---|---|---|
| | Formulation Number | | | | |
| | 6 | 7 | 8 | 9 | 10 |
| DI Water | 8 | 1 | 1 | 19.55 | 19.55 |
| Bayhibit AM | 7.3 | 7.3 | 7.3 | 7.3 | 7.3 |
| Sodium Metasilicate, Anhydrous | | | | 9.45 | 9.45 |
| STPP, Commercial | — | 7 | 7 | — | — |
| TKPP, 60% | 10 | 10 | 10 | 10 | 10 |
| KOH(45%) | 41 | 41 | 41 | 20 | 20 |
| Potassium Hypochlorite | — | — | — | 31.7 | 31.7 |
| Sodium hypochlorite (8.2% $Cl_2$) | 31.7 | 31.7 | 31.7 | — | — |

TABLE 4-continued

| | Formulations 6–10 | | | | |
|---|---|---|---|---|---|
| | Formulation Number | | | | |
| | 6 | 7 | 8 | 9 | 10 |
| Monatrope 1296 | 2 | 2 | — | 2 | — |
| Mona NF-25 | — | — | 2 | — | 2 |
| Total | 100 | 100 | 100 | 100 | 100 |

TABLE 5

| | Formulations 11–16 | | | | | |
|---|---|---|---|---|---|---|
| | Formulation Number | | | | | |
| | 11 | 12 | 13 | 14 | 15 | 16 |
| DI Water | 17.8 | 17.8 | 17.3 | 16.8 | 16.2 | 17.15 |
| Carbopol 676 | — | — | 0.5 | — | — | 0.5 |
| Oxyrite | — | — | — | — | — | 0.05 |
| Gelwhite H NF | — | — | — | 1 | 1.5 | — |
| Tetrasodium EDTA, 40% (<1% NTA) | — | — | — | — | 0.1 | 0.1 |
| Acusol 445 | 6 | 6 | 6 | 6 | 6 | 6 |
| Bayhibit AM | 1.5 | 1.5 | 1.5 | 1.5 | 1.5 | 1.5 |
| Sodium Metasilicate, Anhydrous | 11 | 11 | 11 | 11 | 11 | 11 |
| TKPP, 60% | 10 | 10 | 10 | 10 | 10 | 10 |
| KOH(45%) | 20 | 20 | 20 | 20 | 20 | 20 |
| Potassium Hypochlorite | 31.7 | 31.7 | 31.7 | 31.7 | 31.7 | 31.7 |
| Monatrope 1296 | 2 | — | — | — | 2 | — |
| Mona NF-10 | — | — | 2 | 2 | — | 2 |
| Mona NF-25 | — | 2 | — | — | — | — |
| Total | 100 | 100 | 100 | 100 | 100 | 100 |

TABLE 6

| | Formulations 17–21 | | | | |
|---|---|---|---|---|---|
| | Formulation Number | | | | |
| | 17 | 18 | 19 | 20 | 21 |
| DI Water | 26.25 | 26.80 | 9.08 | — | — |
| KOH, 45% | — | — | 10.00 | — | — |
| TKPP, 60% | 10.00 | 10.00 | 10.00 | 10.00 | 10.00 |
| Kasil #6 (40% K silicate, 2.1) | — | — | 19.17 | 48.80 | 48.80 |
| Carbopol 676 | 0.50 | — | 0.50 | — | — |
| Oxyrite 100 | 0.05 | — | 0.05 | — | — |
| Sodium Metasilicate, Anhydrous | 22.00 | 22.00 | — | — | — |
| KOH, 45% | — | — | 10.00 | — | — |
| Acusol 445 | 6.00 | 6.00 | 6.00 | 6.00 | 6.00 |
| Bayhibit AM | 1.50 | 1.50 | 1.50 | 1.50 | 1.50 |
| Potassium hypochlorite (10.0% $Cl_2$) | 31.70 | 31.70 | 31.70 | 31.70 | 31.70 |
| Mona NF-10 | 2.00 | 2.00 | 2.00 | 2.00 | — |
| Monatrope 1296 | — | — | — | — | 2.00 |
| Total | 100.0000 | 100.0000 | 100.0000 | 100.0000 | 100.0000 |

TABLE 7

| | Formulations 22–26 | | | | |
|---|---|---|---|---|---|
| | Formulation Number | | | | |
| | 22 | 23 | 24 | 25 | 26 |
| DI Water | — | — | — | 19.25 | — |
| KOH, 45% | 19.08 | 20.23 | 18.73 | — | 19.68 |
| TKPP, 60% | 10.00 | 10.00 | 10.00 | 10.00 | 10.00 |
| K Silicate, 2.1 | 19.17 | 19.17 | 19.17 | — | 19.17 |
| Carbopol 676 | 0.50 | — | — | 0.50 | 0.50 |
| Oxyrite 100 | 0.05 | — | — | 0.05 | 0.05 |
| Gelwhite H NF | — | — | 1.50 | — | — |
| KOH, 45% | 10.00 | 10.00 | 10.00 | 20.00 | 10.00 |
| Sodium Metasilicate, Anhydrous | — | — | — | 9.00 | — |
| Acusol 445 | 6.00 | 6.00 | 6.00 | 6.00 | 6.00 |
| Bayhibit AM | 1.50 | 1.50 | 1.50 | 1.50 | 1.50 |
| Potassium hypochlorite (10.0% $Cl_2$) | 31.70 | 31.70 | 31.70 | 31.70 | 31.70 |
| Monatrope 1296-70 | — | 1.40 | 1.40 | — | 1.40 |
| Mona NF-10 | 2.00 | — | — | 2.00 | — |
| Total | 100.00 | 100.00 | 100.00 | 100.00 | 100.00 |

TABLE 8

| | Formulations 27–30 | | | |
|---|---|---|---|---|
| Formulation Number | 27 | 28 | 29 | 30 |
| DI Water | 17.25 | — | — | 10.00 |
| KOH, 45% | 20.00 | 19.08 | 19.08 | 19.08 |
| TKPP, 60% | 10.00 | 10.00 | 10.00 | — |
| K Silicate, 2.1 | — | 19.17 | 19.17 | 19.17 |
| Carbopol 676 | 0.50 | 0.50 | 0.50 | 0.50 |
| Oxyrite 100 | 0.05 | 0.05 | 0.05 | 0.05 |
| Gelwhite H NF | — | — | — | — |
| KOH, 45% | — | 10.00 | 10.00 | 10.00 |
| Sodium Metasilicate, Anhydrous | 11.00 | — | — | — |
| Acusol 445 | 6.00 | 6.00 | 6.00 | 6.00 |
| Bayhibit AM | 1.50 | 1.50 | 1.50 | 1.50 |
| Potassium hypochlorite (10.0% Cl2) | 31.70 | 31.70 | 31.70 | 31.70 |
| Colatrope INC | 2.00 | 2.00 | — | — |
| Colatrope INC-K | — | — | 2.00 | 2.00 |
| Total | 100.00 | 100.00 | 100.00 | 100.00 |

Some of the above formulations were made, and then stored at room temperature. During the storage period, the level of chlorine in each formulation was measured at different time intervals. Tables 9, 10, and 11 summarize the measured chlorine stability of these formulations stored at room temperature. The units for the given data is the measured % $Cl_2$.

TABLE 9

| Measured Chlorine Stability Data for Formulas Stored at Room Temperature (% $Cl_2$). | | | | | |
|---|---|---|---|---|---|
| | Formulation Number | | | | |
| Days | 1 | 2 | 3 | 4 | 5 |
| 0 | — | — | — | 2.8 | 3.1 |
| 1 | 2.57 | — | 3.27 | — | — |
| 2 | — | — | 3.11 | — | — |
| 3 | — | 2.65 | — | — | — |
| 5 | — | 2.63 | — | — | — |
| 6 | — | — | — | 2.97 | 3.07 |

TABLE 9-continued

| Measured Chlorine Stability Data for Formulas Stored at Room Temperature (% $Cl_2$). | | | | | |
|---|---|---|---|---|---|
| | Formulation Number | | | | |
| Days | 1 | 2 | 3 | 4 | 5 |
| 7 | 2.51 | 2.65 | — | — | — |
| 8 | — | — | 3.02 | — | — |
| 9 | 2.51 | — | — | — | — |
| 10 | — | 2.63 | — | — | — |
| 11 | 2.51 | — | — | — | — |
| 14 | 1.54 | — | — | — | — |
| 17 | — | 2.65 | — | — | — |
| 18 | — | — | — | — | — |
| 21 | 2.49 | — | — | — | — |
| 22 | — | — | — | — | — |

TABLE 10

| Measured Chlorine Stability Data for Formulas Stored at Room Temperature (% $Cl_2$). | | | | | | | | | |
|---|---|---|---|---|---|---|---|---|---|
| | Formulation Number | | | | | | | | |
| Days | 6 | 9 | 10 | 11 | 12 | 13 | 14 | 15 | 16 |
| 0 | 1.97 | — | — | 2.38 | 2.24 | — | 2.61 | 2.41 | 2.59 |
| 1 | 1.89 | 2.09 | 1.93 | — | — | 2.52 | — | 2.29 | 2.45 |
| 2 | 1.86 | 1.99 | 1.75 | 2.31 | 2.23 | — | — | 2.28 | 2.43 |
| 3 | — | 1.91 | 1.75 | — | — | — | — | — | — |
| 4 | — | — | — | — | — | — | 2.47 | — | — |
| 5 | — | — | — | — | — | 2.37 | — | 2.13 | 2.33 |
| 6 | — | — | — | — | — | — | — | — | — |
| 7 | — | — | — | 2.13 | 1.97 | — | — | — | — |
| 8 | 1.48 | — | — | — | — | — | — | — | — |
| 9 | — | 1.82 | 1.66 | — | — | — | — | — | — |

TABLE 11

| Measured Chlorine Stability Data for Formulations Stored at Room Temperature (% $Cl_2$) | | | | | |
|---|---|---|---|---|---|
| | Formulation Number | | | | |
| Days | 17 | 18 | 19 | 22 | 29 |
| 0 | 2.34 | 2.15 | 2.16 | 2.27 | 2.27 |
| 1 | — | — | 2.14 | 2.17 | — |
| 2 | 2.19 | 2.13 | 2.13 | — | — |
| 3 | — | — | — | — | — |
| 4 | 2.19 | 2.14 | — | 2.07 | 2.18 |
| 5 | — | — | — | — | 2.1 |

To interpret and extrapolate the chlorine stability of these formulations, the inverses of the measured available chlorine levels are plotted verses time of storage. Plots resulting in straight lines indicate 2nd order reactions, with the slopes of the lines being the rates of degradation, as can be represented by the equation below:

$$1/[Cl_2]=1/[Cl_2]_0+kt$$

wherein:

$[Cl_2]$ is the concentration of chlorine at time t, $[Cl_2]_0$ is the concentration of chlorine at time 0, t=time of storage, and k is the rate of degradation.

The rate of degredation (k) of the chlorine of each of the formulations can be calculated using the above formula. Tables 12, 13, and 14 show the calculated rate of degradation in units of $(\%\ day)^{-1}$ that were calculated for each formulation using the above data and formula.

TABLE 12

Calculated Rates of Chlorine Degradation at Room Temperature in units of $(\%\ day)^{-1}$

| | Formulation Number | | | | |
|---|---|---|---|---|---|
| | 1 | 2 | 3 | 4 | 5 |
| Chlorine Degradation Rate Constant (k) | 0.0006 | 2.00E−05 | 0.0029 | −0.0034 | 0.0005 |

TABLE 13

Calculated Rates of Chlorine Degradation at Room Temperature in units of $(\%\ day)^{-1}$

| | Formulation Number | | | | | | | | |
|---|---|---|---|---|---|---|---|---|---|
| | 6 | 9 | 10 | 11 | 12 | 13 | 14 | 15 | 16 |
| Chlorine Degradation Rate Constant (k)) | 0.0212 | 0.0077 | 0.008 | 0.0071 | 0.0093 | 0.0063 | 0.0054 | 0.0101 | 0.0077 |

TABLE 14

Calculated Rates of Chlorine Degradation at Room Temperature in Units of $(\%\ day)^{-1}$

| | Formulation Number | | | | |
|---|---|---|---|---|---|
| | 17 | 18 | 19 | 22 | 29 |
| Chlorine Degradation Rate Constant (k) | 0.0073 | 0.0005 | 0.0033 | 0.0099 | 0.0064 |

Example 3

In this example, the same formulations form Example 2 were made, and the chlorine stability of these formulations was measured when stored at 120° F. Each of the formulations was made and stored at 120° F. for a period of days. During the storage period, the level of chlorine in each formulation was measured at different time intervals. Table 15, 16, and 17 summarize the measured chlorine stability of these formulations stored at 120° F. The units for the given data is the measured % $Cl_2$.

TABLE 15

Measured Chlorine Stability Data for Formulas Stored at 120° F. (% $Cl_2$).

| | Formulation Number | | | | |
|---|---|---|---|---|---|
| Days | 1 | 2 | 3 | 4 | 5 |
| 0 | — | — | — | 2.8 | 3.1 |
| 1 | 2.55 | — | 3.12 | — | — |
| 2 | — | — | 2.98 | — | — |
| 3 | — | 2.26 | — | — | — |
| 5 | — | 1.98 | — | — | — |
| 6 | — | — | — | 1.98 | 1.42 |
| 7 | 1.76 | 1.86 | — | — | — |
| 8 | — | — | 2.18 | — | — |
| 9 | 1.57 | — | — | — | — |
| 11 | 1.5 | — | — | — | — |
| 18 | — | 1.2 | — | — | — |
| 21 | 1.08 | — | — | — | — |
| 22 | — | — | — | — | — |

TABLE 16

Measured Chlorine Stability Data for Formulas Stored at 120° F. (% $Cl_2$).

| | Formulation Number | | | | | | | | |
|---|---|---|---|---|---|---|---|---|---|
| Days | 6 | 9 | 10 | 11 | 12 | 13 | 14 | 15 | 16 |
| 0 | 1.97 | — | — | 2.38 | 2.24 | — | 2.61 | 2.41 | 2.59 |
| 1 | 1.47 | 1.77 | 1.61 | — | — | 2.34 | — | 1.95 | 2.16 |
| 2 | 1.29 | 1.47 | 1.56 | 1.69 | 1.63 | — | — | 1.68 | 1.84 |
| 3 | — | 1.34 | 1.42 | — | — | — | — | — | — |
| 4 | — | — | — | — | — | — | 1.21 | — | — |
| 5 | — | — | — | — | — | 0.61 | 0.98 | 1.1 | 1.39 |
| 6 | — | — | — | — | — | 0.42 | — | — | — |
| 7 | — | — | — | 0.37 | 0.43 | — | — | — | — |
| 8 | 0.21 | — | — | 0.23 | 0.32 | — | — | — | 0.91 |
| 9 | — | 0.37 | 0.79 | — | — | — | — | — | — |

TABLE 17

Measured Chlorine Stability Data for Formulas Stored at 120° F. (% $Cl_2$).

| | Formulation Number | | | | | | | | | | | |
|---|---|---|---|---|---|---|---|---|---|---|---|---|
| Days | 17 | 18 | 19 | 22 | 23 | 24 | 25 | 26 | 27 | 28 | 29 | 30 |
| 0 | 2.34 | 2.15 | 2.16 | 2.27 | 2.00 | 2.04 | 2.24 | 2.03 | 2.26 | 2.25 | 2.27 | 2.16 |
| 1 | — | — | 2.02 | 2.00 | 1.76 | 1.86 | 1.99 | 1.81 | 2.10 | 2.02 | — | — |
| 2 | 1.85 | 1.98 | 2.00 | — | — | — | — | — | 1.91 | 1.90 | | |
| 3 | — | — | — | — | — | — | — | — | — | — | — | — |
| 4 | 1.81 | 1.58 | — | 1.41 | — | — | — | — | — | — | 1.65 | 1.69 |
| 5 | — | — | — | — | — | — | — | — | 1.63 | 1.72 | 1.48 | 1.56 |
| 6 | — | — | — | — | — | — | — | — | 1.53 | 1.29 | — | — |
| 7 | — | — | — | — | — | — | — | — | 1.5 | 1.21 | — | — |
| 8 | — | — | — | — | — | — | — | — | — | 1.05 | — | — |

The rate of degradation (k) of the chlorine of each of the formulations can be calculated using the above formula. Tables 18, 19, and 20 show the calculated rate of degradation in units of (% day)$^{-1}$ that were calculated for each formulation using the above data and formula.

TABLE 18

Calculated Rates of Chlorine Degradation at 120° F. in units of (% day)$^{-1}$

| | Formulation Number | | | | |
|---|---|---|---|---|---|
| | 1 | 2 | 3 | 4 | 5 |
| Chlorine Degradation Rate Constant (k) | 0.0264 | 0.0259 | 0.0201 | 0.0247 | 0.0636 |

Through conducting Examples 2 and 3, we discovered that when we replaced part of the caustic (a fully ionized source of alkalinity) with metasilicate (a less than fully ionized source of alkalinity), even though we still maintained similar overall titratable level of alkalinity, we could significantly reduce the degradation rate of chlorine in the formulation, making their shelf-life much more acceptable. Particularly illustrative examples include those shown in Formula numbers 9–30

Example 4

In this example, we will show a direct comparison of some of the properties of formulations 6 and 16 from Examples 2 and 3 above. For illustration, some of the properties of Formulations 6 and 16 are compared below in Table 21.

TABLE 19

Calculated Rates of Chlorine Degradation at 120° F. in units of (% day)$^{-1}$

| | Formulation Number | | | | | | | | |
|---|---|---|---|---|---|---|---|---|---|
| | 6 | 9 | 10 | 11 | 12 | 13 | 14 | 15 | 16 |
| Chlorine Degradation Rate Constant (k) | 0.6115 | 0.2809 | 0.0848 | 0.4608 | 0.3315 | 0.3657 | 0.1227 | 0.0989 | 0.0659 |

TABLE 20

Calculated Rates of Chlorine Degradation at 120° F. in units of (% day)$^{-1}$

| | Formulation Number | | | | | | | | | | |
|---|---|---|---|---|---|---|---|---|---|---|---|
| | 17 | 18 | 19 | 22 | 23 | 24 | 25 | 26 | 27 | 28 | 29 |
| Chlorine Degradation Rate Constant (k) | 0.0313 | 0.0419 | 0.0185 | 0.0678 | 0.0682 | 0.0474 | 0.0561 | 0.0599 | 0.0405 | 0.0442 | 0.0454 |

TABLE 21

| Formula Number | 6 | 16 |
|---|---|---|
| Primary Alkalinity Sources | 18.45% KOH | 9% KOH, and 11% Sodium metasilicate |
| Test Set Factor | 313.7 | 317 |
| k when stored at room temperature | 0.0212 (% day)$^{-1}$ | 0.0077 (% day)$^{-1}$ |
| k when stored at 120° F. | 0.6115 (% day)$^{-1}$ | 0.0659 (% day)$^{-1}$ |

The Test Set Factor is defined as the inverse of the milliliters of titration when the compositions were titrated with a hydrochloric acid titrant to determine the level of titratable alkalinity within the formulations. The above comparison clearly show that even though the two formulas have roughly equivalent titratable alkalinity, Formulation 16 has radically better chlorine stability than that of Formulation 6. When stored at room temperature, the degradation rate of chlorine in Formulation 16 is only about ⅓ that of Formulation 6. When stored at 120° F., the degradation rate of chlorine in Formulation 16 is only about ⅙ that of Formulation 6.

Example 5

In this example, a formulation was made having a less than fully ionized source of alkalinity as the sole source of alkalinity within the composition. Table 22, below, summarizes the components and weight percents of this formulation.

TABLE 22

| Component | Weight Percent |
|---|---|
| Soft Water | 52.65 |
| Gelwhite H NF | 1.25 |
| Sodium Tripolyphosphate | 5.00 |
| Sodium Metasilicate | 12.00 |
| Monatrope 1296 | 4.00 |
| EDTA 40% | 0.10 |
| Sodium Hypochlorite | 25.00 |
| Total | 100 |

Two batches of the above formulation were made, and one was stored at room temperature, and the other was stored at 120° F. During the storage period, the level of chlorine in each batch was measured at different time intervals. Tables 23 and 24 summarize the measured chlorine stability of this formulation stored at room temperature and at 120° F.

TABLE 23

Measured Chlorine Stability Data for Formulation Stored at Room Temperature

| Days | Available Chlorine (% $Cl_2$) | 1/$Cl_2$ |
|---|---|---|
| 1 | 3.2000 | 0.3125 |
| 4 | 3.1145 | 0.3211 |
| 7 | 3.0656 | 0.3262 |
| 14 | 3.0371 | 0.3293 |
| 21 | 2.9308 | 0.3412 |
| 28 | 2.7842 | 0.3592 |
| 36 | 2.6854 | 0.3724 |
| 42 | 2.6336 | 0.3797 |

TABLE 24

Measured Chlorine Stability Data for Formulation Stored at 120° F.

| Days | Available Chlorine (% $Cl_2$) | 1/$Cl_2$ |
|---|---|---|
| 1 | 3.2000 | 0.3125 |
| 4 | 2.5676 | 0.3895 |
| 7 | 2.0483 | 0.4882 |
| 14 | 1.2757 | 0.7839 |
| 21 | 0.8341 | 1.1989 |
| 28 | 0.4813 | 2.0775 |
| 36 | 0.2273 | 4.3995 |
| 42 | 0.12886 | 7.7604 |

From this data, the rate of degradation (k) of the chlorine when stored at both room temperature and at 120° F. can be calculated using the formula given above. Additionally, one month and six month chlorine measurements were taken to calculate the percent degradation of chlorine at both room temperature and 120° F. storage conditions. The results are shown in Tables 25 and 26 below.

TABLE 25

Chlorine Stability Data for Storage at Room Temperature

| Chlorine Degradation Rate Constant (k) | 1/Cl2 at start | Day 0 Chlorine concentration | 1 Month chlorine concentration | % decline over 1 Month | 6 Month chlorine concentration | % decline over 6 months |
|---|---|---|---|---|---|---|
| 0.0016 | 0.3125 | 3.2 | 2.773925 | 13.3148405 | 1.665279 | 47.96 |

TABLE 26

Chlorine Stability Data for Storage at 120° F.

| Chlorine Degradation Rate Constant (k) | 1/Cl2 at start | Day 0 Chlorine concentration | 1 Month chlorine concentration | % decline over 1 Month | 6 Month chlorine concentration | % decline over 6 months |
|---|---|---|---|---|---|---|
| 0.1548 | 0.3125 | 3.2 | 0.201755 | 93.6951478 | 0.035491 | 98.89092 |

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

We claim:

1. A cleaning composition having improved chlorine stability, the composition comprising:

one or more less than fully ionized source of alkalinity within the cleaning composition;

a source of chlorine; and a polar carrier;

wherein the one or more less than fully ionized source of alkalinity is the sole alkalinity source within the composition, and wherein the composition does not include an additional chlorine bleach stabilizer compound.

2. The cleaning composition of claim 1, wherein at least a portion of the less than fully ionized source of alkalinity within the composition forms ion pairs within the composition.

3. The cleaning composition of claim 1, wherein a portion of the less than fully ionized source of alkalinity within the composition is in the form of a colloidal suspension within the composition.

4. The cleaning composition of claim 1, wherein a portion of the less than fully ionized source of alkalinity within the composition is in the form of a solid dispersed within the composition.

5. The cleaning composition of claim 1, wherein the source of chlorine has an increased level of stability within the cleaning composition relative to a second composition having the same components and same level of titratable alkalinity, but that includes a fully ionized source of alkalinity as a sole source of alkalinity.

6. The cleaning composition of claim 1, wherein the source of chlorine within the composition has in the range of about 50% or less loss of activity over a one month period of time when stored at room temperature.

7. The cleaning composition of claim 1, wherein the degradation of chlorine within the composition when stored at room temperature follows a second order reaction.

8. The cleaning composition of claim 1, wherein the second order rate constant for the degradation of the chlorine within the composition when the composition is stored at room temperature is in the range of about 0.001 and 0.01 (% day)$^{-1}$.

9. The cleaning composition of claim 1, wherein the less than fully ionized source of alkalinity is present in the composition in the range of about 0.5 to about 40% by weight of the total composition.

10. The cleaning composition of claim 1, wherein the less than fully ionized source of alkalinity is present in the composition in the range of about 5 to about 40% by weight of the total composition.

11. The cleaning composition of claim 1, wherein the less than fully ionized source of alkalinity is present in the composition in the range of about 0.5 to about 5% by weight of the total composition.

12. The cleaning composition of claim 1, wherein the total of sources of alkalinity within the composition is in the range of about 0.5 to about 50% by weight.

13. The cleaning composition of claim 1, wherein the less than fully ionized source of alkalinity comprises a silicate salt, a phosphate salt, a polyphosphate salt, a carbonate salt, a borate salt, or combinations or mixtures thereof.

14. The cleaning composition of claim 1, wherein the less than fully ionized source of alkalinity comprises sodium silicate, sodium metasilicate, sodium orthosilicate, sodium phosphate, sodium polyphosphate, sodium borate, sodium carbonate, potassium silicate, potassium metasilicate, potassium orthosilicate, potassium phosphate, potassium polyphosphate, potassium borate, potassium carbonate, lithium silicate, lithium metasilicate, lithium orthosilicate, lithium phosphate, lithium polyphosphate, lithium borate, lithium carbonate, or mixtures of combinations thereof.

15. The cleaning composition of claim 1, wherein the source of chlorine is present in the composition in the range of about 0.5 to about 50% by weight of the total composition.

16. The cleaning composition of claim 1, wherein the source of chlorine comprises: a hypochlorite, a chlorinated phosphate, a chlorinated isocyanaurate, a chlorinated melamine, a chlorinated amide, or mixtures of combinations thereof.

17. The cleaning composition of claim 1, wherein the source of chlorine comprises sodium hypochlorite, potassium hypochlorite, calcium hypochlorite, lithium hypochlorite, chlorinated trisodiumphosphate, sodium dichloroisocyanurate, potassium dichloroisocyanurate, pentaisocyanurate, trichloromelamine, sulfondichloroamide, 1,3-dichloro 5,5-dimethyl hydantoin, N-chlorosuccinimide, N,N'-dichloroazodicarbonimide, N,N'-chloroacetylurea, N,N'-dichlorobiuret, trichlorocyanuric acid or hydrates thereof, or combinations or mixtures thereof.

18. The cleaning composition of claim 1, wherein the polar carrier is water.

19. The cleaning composition of claim 1, wherein the composition further includes an additional functional ingredient.

20. The cleaning composition of claim 19, wherein the additional functional ingredients comprise a chelating agent, a sequestering agent, a surfactant, a defoamer, a thickening agent, a bleaching agent, a solubility modifier, a detergent filler, an anti-redeposition agent, a threshold agent or system, an aesthetic enhancing agent, or combinations or mixtures thereof.

21. The cleaning composition of claim 19, wherein the additional functional ingredient comprises, a chlorine compatible chelating agent, a chlorine compatible sequestering agent, a chlorine compatible surfactant, a chlorine compatible protein soil defoamer, a chlorine compatible thickener, or combinations or mixtures thereof.

22. The cleaning composition of claim 1, wherein the cleaning composition is a concentrated cleaning composition that can thereafter be diluted with a diluent to form a use composition.

23. The cleaning composition of claim 22, wherein when the concentrated cleaning composition is diluted with the diluent to form the use composition, at least a portion of the less than fully ionized source of alkalinity within the concentrated cleaning composition becomes ionized.

24. A concentrated cleaning composition having improved chlorine stability, the composition comprising:

one or more source of alkalinity that is less than fully ionized within the concentrated cleaning composition, the source of alkalinity including alkali metal silicate, alkali metal metasilicate, alkali metal orthosilicate, or mixtures or combinations thereof, wherein the composition does not include a fully ionized source of alkalinity;

a source of chlorine; and a polar carrier;

wherein the composition does not include an additional chlorine bleach stabilizer compound.

25. The cleaning composition of claim 24, wherein the source of chlorine has an increased level of stability within the concentrated cleaning composition relative to a second composition having the same components and same level of titratable alkalinity, but that includes a fully ionized source of alkalinity as a sole source of alkalinity.

26. The cleaning composition of claim 24, wherein the source of chlorine within the composition has in the range of about 20% or less loss of activity over a one month period of time when stored at room temperature.

27. A alkali cleaning composition having improved chlorine stability, the composition comprising:

one or more less than fully ionized source of alkalinity present in the composition in amounts in the range of about 0.5 to about 40% by weight of the total composition, wherein the one or more less than fully ionized source of alkalinity is the sole alkalinity source within the composition;

a source of chlorine present in the composition in amounts in the range of about 0.5 to about 12% by weight of the total composition; and a polar carrier;

wherein the composition does not include an additional chlorine bleach stabilizer compound.

28. The cleaning composition of claim 27, wherein the less than fully ionized source of alkalinity is present in the composition in the range of about 5 to about 40% by weight of the total composition.

29. The cleaning composition of claim 27, wherein the less than fully ionized source of alkalinity is present in the composition in the range of about 10 to about 40% by weight of the total composition.

30. The alkali cleaning composition of claim 27, wherein the composition further comprises a chelating agent present in the composition in the range of about 0.01 to 30% by weight of the total composition.

31. The alkali cleaning composition of claim 27, wherein the composition further comprises a sequestering agent present in the composition in the range of about 0.01 to 30% by weight of the total composition.

32. The alkali cleaning composition of claim 27, wherein the composition further comprises a surfactant present in the composition in the range of about 0.01 to 20% by weight of the total composition.

33. The alkali cleaning composition of claim 27, wherein the composition further comprises a protein soil defoamer present in the composition in the range of about 0.01 to 20% by weight of the total composition.

34. The alkali cleaning composition of claim 19, wherein the composition further comprises a thickener present in the composition in the range of about 0.01 to 30% by weight of the total composition.

35. A method of producing a cleaning composition having improved chlorine stability, the method comprising:

admixing the following components:

one or more source of alkalinity that is less than fully ionizable within the composition;

a source of chlorine; and a polar carrier;

wherein the one or more less than fully ionizable source of alkalinity is the sole alkalinity source within the composition, and the composition does not include an additional chlorine bleach stabilizer compound.

36. The method of claim 35, wherein the source of chlorine has an increased level of stability within the cleaning composition relative to a second composition having the same components and same level of titratable alkalinity, but that includes a fully ionized source of alkalinity as a sole source of alkalinity.

37. The method of claim 35, wherein the source of chlorine within the composition has in the range of about 50% or less loss of activity over a one month period of time when stored at room temperature.

38. The method of claim 35, wherein the degradation of chlorine within the composition when stored at room temperature follows a second order reaction.

39. The method of claim 35, wherein the second order rate constant for the degradation of the chlorine within the composition when the composition is stored at room temperature is in the range of about 0.001 and 0.01 $(\%\ \text{day})^{-1}$.

40. The method of claim 35, wherein the less than fully ionized source of alkalinity is present in the composition in the range of about 0.5 to about 40% by weight of the total composition.

41. The method of claim 35, wherein the less than fully ionized source of alkalinity is present in the composition in the range of about 5 to about 40% by weight of the total composition.

42. The method of claim 35, wherein the total of all sources of alkalinity within the composition is in the range of about 0.5 to about 50% by weight.

43. The method of claim 35, wherein the less than fully ionized source of alkalinity comprises a silicate salt, a phosphate salt, a polyphosphate salt, a carbonate salt, a borate salt, or combinations or mixtures thereof.

44. The method of claim 35, wherein the less than fully ionized source of alkalinity comprises sodium silicate, sodium metasilicate, sodium orthosilicate, sodium phosphate, sodium polyphosphate, sodium borate, sodium carbonate, potassium silicate, potassium metasilicate, potassium orthosilicate, potassium phosphate, potassium polyphosphate, potassium borate, potassium carbonate, lithium silicate, lithium metasilicate, lithium orthosilicate, lithium phosphate, lithium polyphosphate, lithium borate, lithium carbonate, or mixtures of combinations thereof.

45. The method of claim 35, wherein the admixing step further includes admixing an additional functional ingredient with the other components.

46. A method of cleaning a soil from a substrate, the method comprising:

providing a cleaning composition having improved chlorine stability, the composition comprising:

one or more source of alkalinity that is less than fully ionized within the concentrated cleaning composition;

a source of chlorine; and a polar carrier;

wherein the one or more less than fully ionizable source of alkalinity is the sole alkalinity source within the composition, and the composition does not include an additional chlorine bleach stabilizer compound;

applying the cleaning composition to the substrate; and removing at least some of the cleaning composition at least some of the soil from the substrate.

47. A method of stabilizing chlorine within an alkali cleaning composition, the method comprising:

providing the composition with one or more source of alkalinity that is less than fully ionized within the cleaning composition; and providing the composition with a source of chlorine;

wherein the one or more less than fully ionized source of alkalinity is the sole alkalinity source within the composition, and wherein the chlorine is stabilized without the use of an additional chlorine bleach stabilizer compound.

* * * * *